US009867468B2

(12) United States Patent
Wu

(10) Patent No.: US 9,867,468 B2
(45) Date of Patent: Jan. 16, 2018

(54) ADJUSTABLE CHAIR

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 0 days.

(21) Appl. No.: 15/238,714

(22) Filed: Aug. 16, 2016

(65) Prior Publication Data

US 2017/0273463 A1 Sep. 28, 2017

(30) Foreign Application Priority Data

Mar. 23, 2016 (CN) ..... 2016 2 0228759

(51) Int. Cl.

| | |
|---|---|
| ***A47C 7/44*** | (2006.01) |
| ***A47C 7/00*** | (2006.01) |
| ***A47C 7/54*** | (2006.01) |
| ***A47C 3/18*** | (2006.01) |
| ***A47C 7/02*** | (2006.01) |

(52) U.S. Cl.

CPC ..... *A47C 7/441* (2013.01); *A47C 3/18* (2013.01); *A47C 7/006* (2013.01); *A47C 7/02* (2013.01); *A47C 7/445* (2013.01); *A47C 7/54* (2013.01)

(58) Field of Classification Search

CPC ..... A47C 7/441; A47C 3/18; A47C 7/006; A47C 7/02; A47C 7/445; A47C 7/54

USPC ..... 297/320

See application file for complete search history.

(56) References Cited

U.S. PATENT DOCUMENTS

| | | | | |
|---|---|---|---|---|
| 6,709,058 | B1 * | 3/2004 | Diffrient | A47C 1/03 297/320 |
| 7,441,839 | B2 * | 10/2008 | Pennington | A47C 1/023 297/320 X |
| 2013/0169017 | A1 * | 7/2013 | Masunaga | A47C 1/03255 297/320 |
| 2015/0289660 | A1 * | 10/2015 | Su | A47C 1/03272 297/298 |

* cited by examiner

*Primary Examiner* — Anthony D Barfield

(74) *Attorney, Agent, or Firm* — Pai Patent & Trademark Law Firm; Chao-Chang David Pai

(57) ABSTRACT

An adjustable chair has a seat and a splat. The seat has a lower base, an upper base, a tilt adjusting device, a lower rotating shaft, and an upper rotating shaft. The lower base has an assembling space. The upper base is movably deposited on the lower base. The tilt adjusting device is deposited in the assembling space. The lower rotating shaft is rotatably deposited in the lower base and connected to the tilt adjusting device. The upper rotating shaft is deposited in the upper base. The splat is tiltably connected to the seat and has a backrest unit and two connecting legs. The backrest unit is deposited at a rear side of the seat. The connecting legs are connected to the backrest unit, are connected to the lower rotating shaft, and are pivotally connected to the upper rotating shaft.

8 Claims, 6 Drawing Sheets

ADJUSTABLE CHAIR

BACKGROUND OF THE INVENTION

1. Field of the Invention

The present invention relates to an adjustable chair, and more particularly to an adjustable chair that may change and adjust a tilt angle of a splat of the adjustable chair comfortably and safely.

2. Description of Related Art

In order to improve comfort, a conventional chair has an adjusting function for adjusting a tilt angle of a splat of the conventional chair. Then, a user may adjust and lock the tilt angle of the splat of the conventional chair according to the user's need. Furthermore, the splat is connected to a seat of the conventional chair, and the seat has a base plate deposited below the seat. The conventional chair further has a rotating device and a locking device deposited between the seat and the base plate. The rotating device has a rotating shaft connected to the splat to change and adjust the tilt angle of the splat. The locking device is used to fix and lock the tilt angle of the splat of the conventional chair.

However, when the splat is adjusted to tilt backwardly relative to the seat, a part of the seat that is deposited in the front of the rotating shaft may tilt upwardly, and another part of the seat that is deposited in the rear of the rotating shaft may tilt downwardly. When the seat is tilted backwardly and downwardly during adjusting of the tilt angle of the splat of the conventional chair, the user may feel uncomfortable.

To overcome the shortcomings, the present invention provides an adjustable chair to mitigate or obviate the aforementioned problems.

SUMMARY OF THE INVENTION

The main objective of the present invention is to provide an adjustable chair that may change and adjust a tilt angle of a splat of the adjustable chair comfortably and safely.

The adjustable chair in accordance with the present invention has a seat and a splat. The seat has a lower base, an upper base, a tilt adjusting device, a lower rotating shaft, and an upper rotating shaft. The lower base has an open top and an assembling space. The upper base is movably deposited on the lower base to cover the open top of the lower base. The tilt adjusting device is deposited in the assembling space. The lower rotating shaft is rotatably deposited in the lower base, and is connected to the tilt adjusting device. The upper rotating shaft is deposited in the upper base and is parallel with the lower rotating shaft. The splat is tiltably connected to the seat and has a backrest unit and two connecting legs. The backrest unit is deposited at a rear side of the seat and has two bottom ends. The connecting legs are respectively connected to the bottom ends of the backrest unit, and each one of the connecting legs is securely connected to the lower rotating shaft and is pivotally connected to the upper rotating shaft, and has a connecting segment extending upwardly to the seat.

Other objectives, advantages and novel features of the invention will become more apparent from the following detailed description when taken in conjunction with the accompanying drawings.

DETAILED DESCRIPTION OF PREFERRED EMBODIMENT

Figure 1:
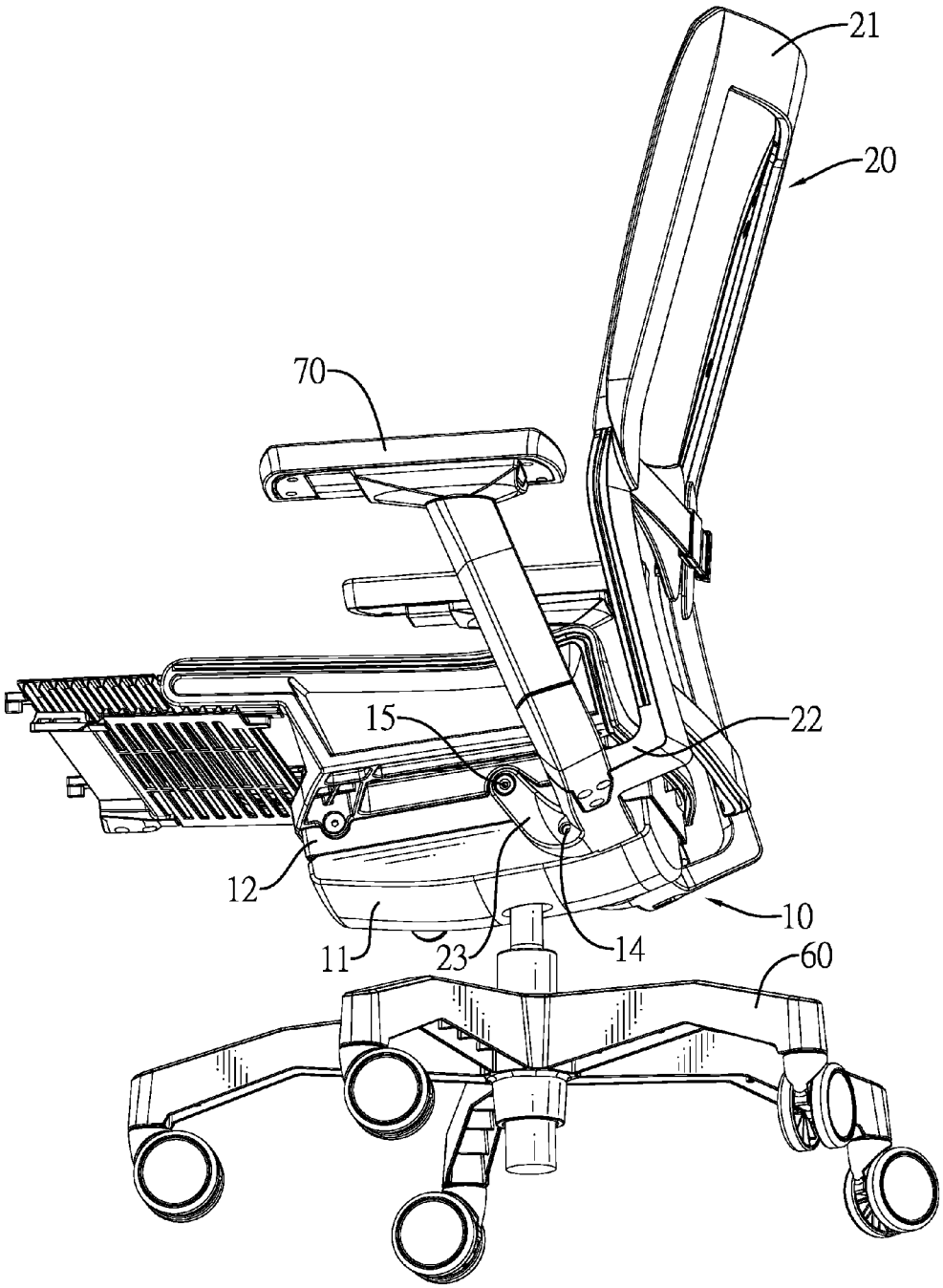
FIG. 1 is a perspective view of an adjustable chair in accordance with the present invention.
Figure 2:
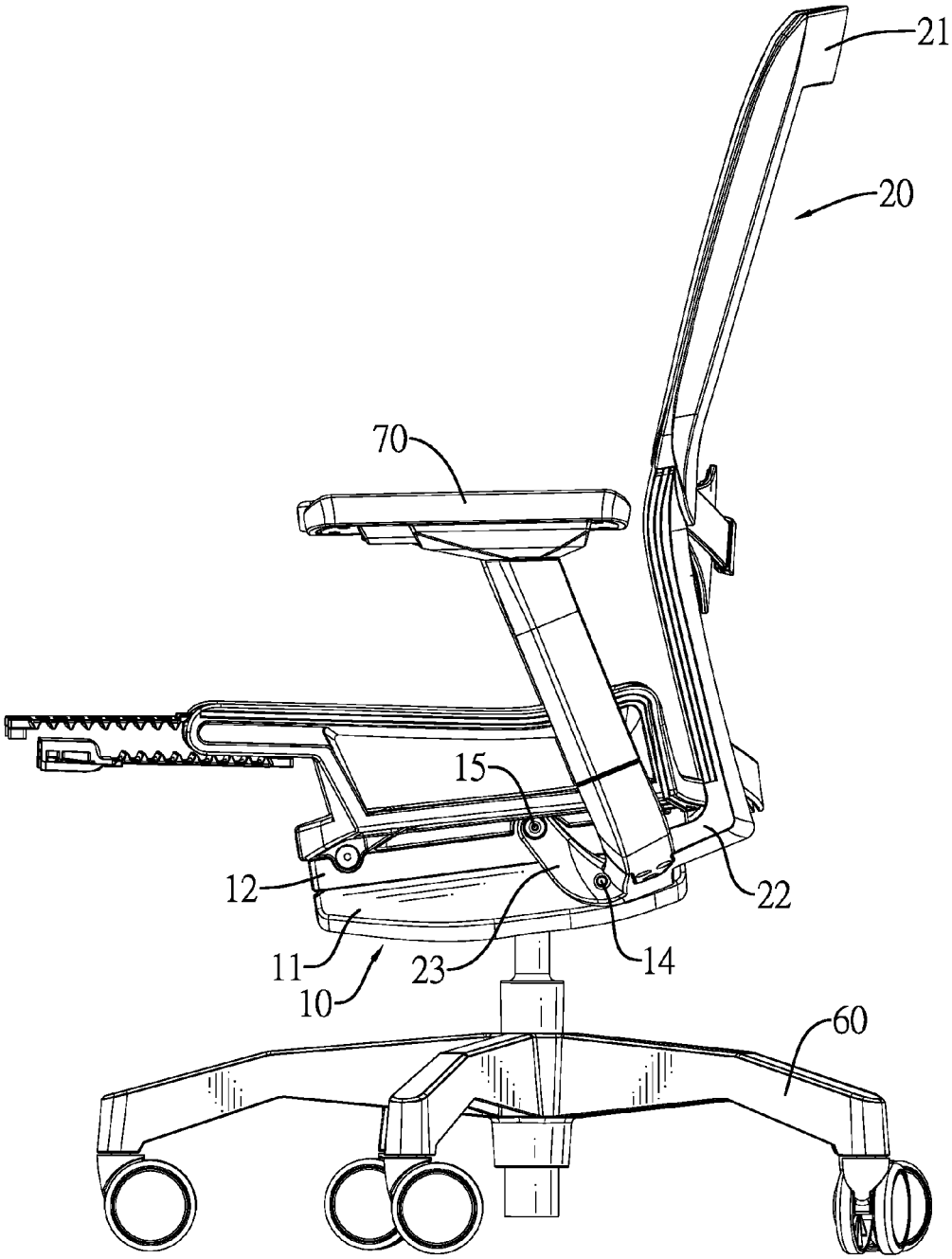
FIG. 2 is a side view of the adjustable chair in FIG. 1.

With reference to FIGS. 1 and 2, an adjustable chair in accordance with the present invention has a seat 10 and a splat 20.

Figure 4:
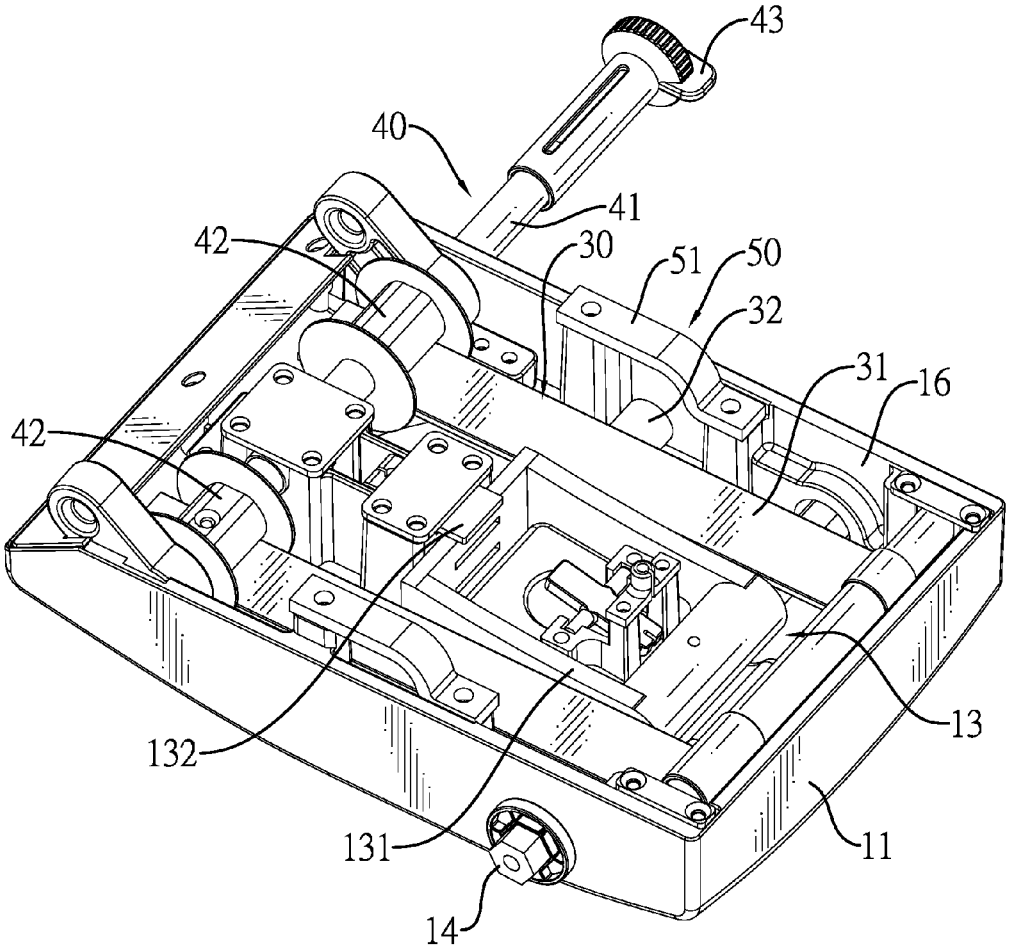
FIG. 4 is an enlarged perspective view of a lower base of a seat of the adjustable chair in FIG. 1.
Figure 5:
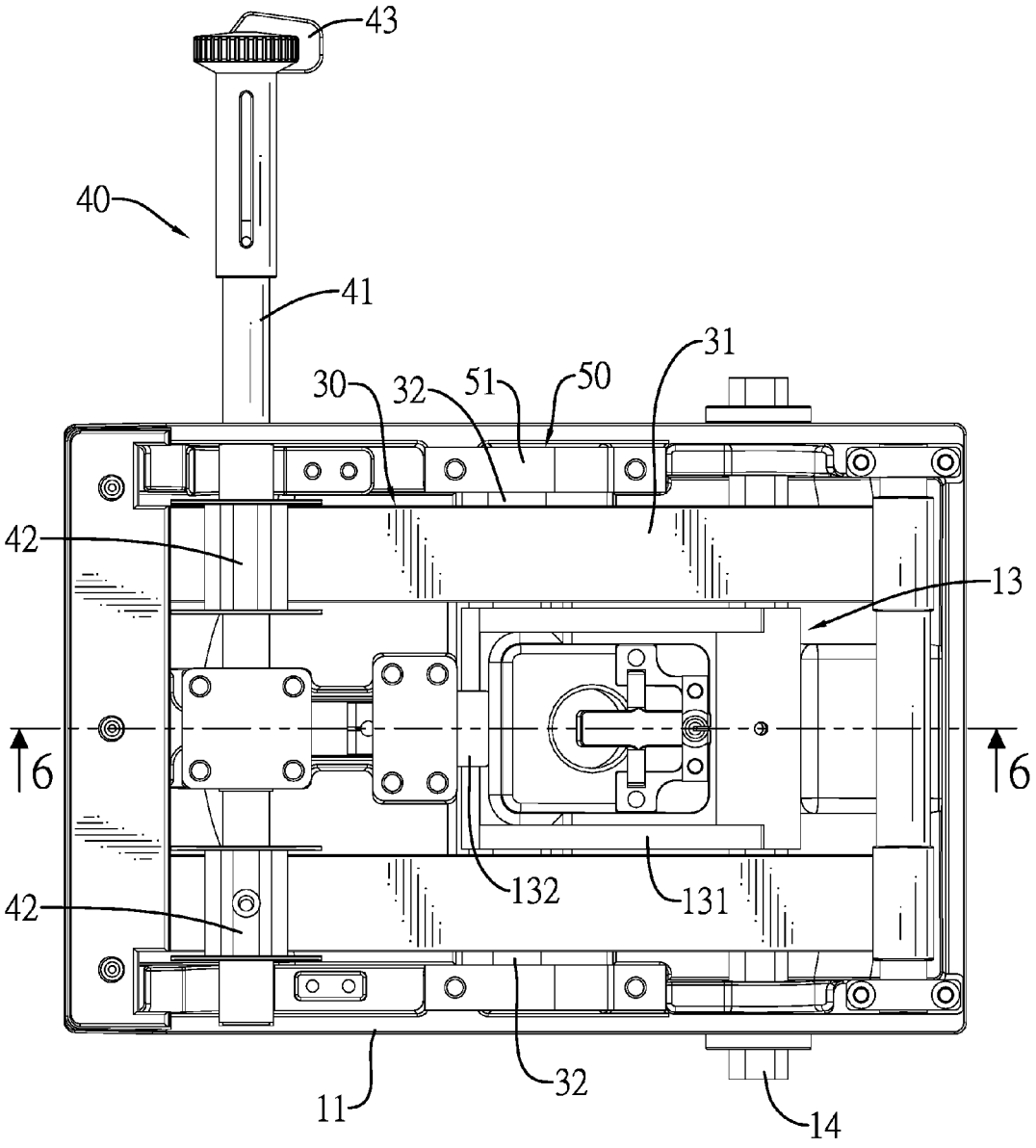
FIG. 5 is a top view of the lower base of the seat of the adjustable chair in FIG. 4.

With reference to FIGS. 2, 4, and 5, the seat 10 has a lower base 11, an upper base 12, a tilt adjusting device 13, a lower rotating shaft 14, and an upper rotating shaft 15. The lower base 11 has a closed bottom, an open top, a front side, a rear side, two opposite sides, and an assembling space 16. The assembling space 16 is formed in the lower base 11 and communicates with the open top of the lower base 11. The upper base 12 is movably deposited on the lower base 11 to cover the open top of the lower base 11 and has two opposite sides.

The tilt adjusting device 13 is deposited in the assembling space 16 of the lower base 11. The lower rotating shaft 14 is rotatably deposited in the lower base 11 adjacent to the rear side of the lower base 11, is connected to the tilt adjusting device 13, and has two outer ends respectively extending out of the two opposite sides of the loser base 11. The upper rotating shaft 15 is deposited in the upper base 12, is parallel with the lower rotating shaft 14, and has two outer ends respectively extending out of the two opposite sides of the upper base 12.

Figure 3:
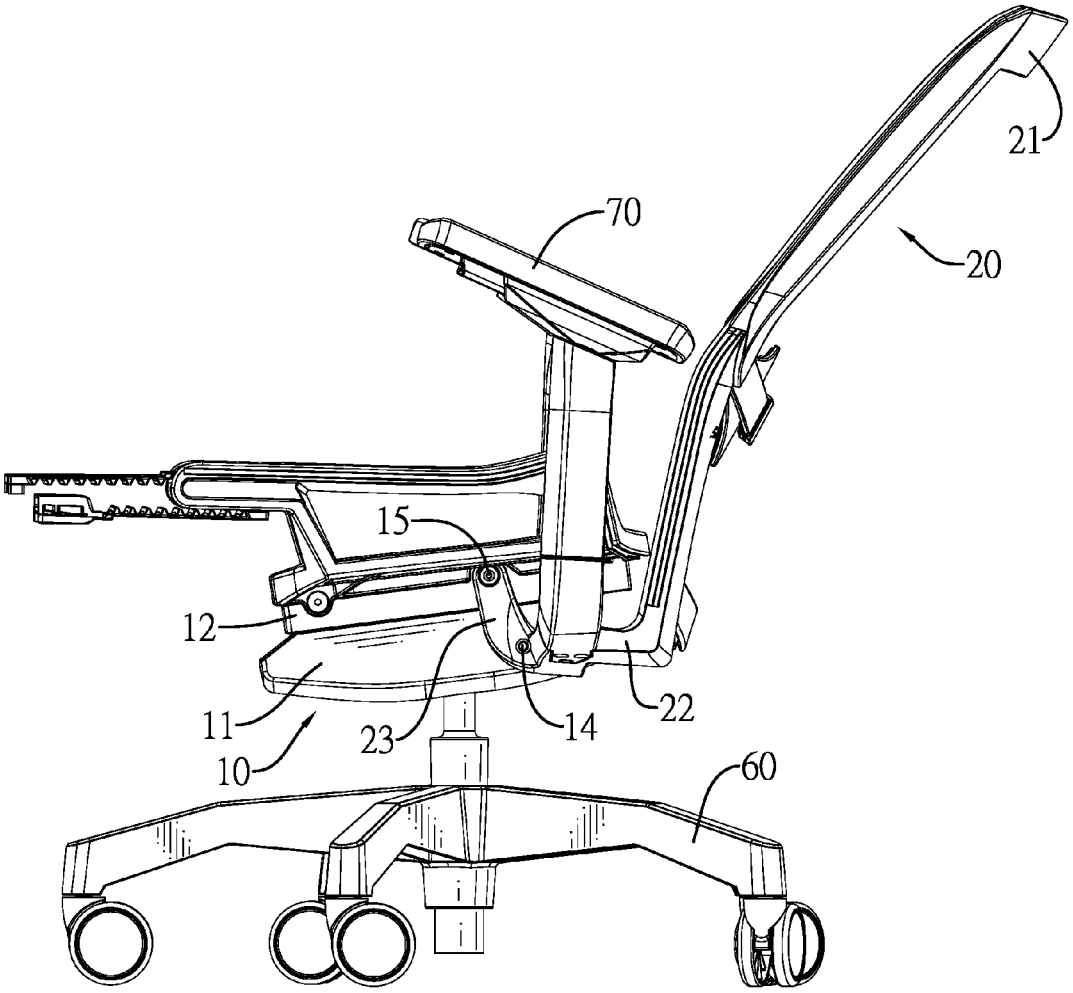
FIG. 3 is an operational side view of the adjustable chair in FIG. 1.

With reference to FIGS. 1 to 3, the splat 20 is tiltably connected to the seat 10 and has a backrest unit 21 and two connecting legs 22. The backrest unit 21 is deposited at a rear side of the seat 10 and has two bottom ends. The connecting legs 22 are respectively connected to the bottom ends of the backrest unit 21, and each one of the connecting legs 22 is securely connected to the lower rotating shaft 14 and is pivotally connected to the upper rotating shaft 15 at one of the two opposite sides of the lower base 11. In addition, each one of the connecting legs 22 has a connecting segment 23 extending upwardly to the seat 10.

According to the above-mentioned features and structural relationships, the structure of the seat 10 is simplified, and the lower base 11 and the upper base 12 may be assembled easily and the total volume of the seat 10 may be reduced. With reference to FIGS. 2 and 3, when the splat 20 is tilted backwardly relative to the seat 10, the connecting legs 22 are rotated with the lower rotating shaft 14 and are rotated pivotally relative to the upper rotating shaft 15. Then, the connecting segments 23 of the connecting legs 22 may enable the upper base 12 to move backwardly relative to the lower base 11 without tilting. Then, when a user sits on the upper base 12 of the seat 10, the user will move backwardly with the upper base 12 without tilting, and the user will not feel uncomfortable when adjusting the tilt angle of the splat 20, and this may improve the comfort of using the adjustable chair.

Figure 6:
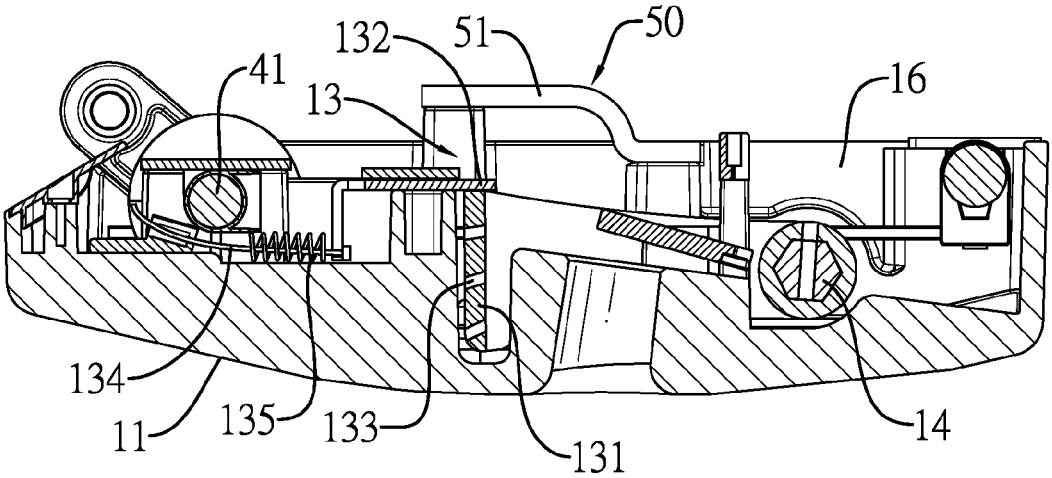
FIG. 6 is a side view in partial section of the lower base of the seat of the adjustable chair along line 6-6 in FIG. 5.

With reference to FIGS. 4 to 6, the tilt adjusting device 13 further has a locking frame 131, a latch 132, a rope 134, and a spring 135. The locking frame 131 may be U-Shaped, is mounted in the lower base 11, and is connected securely with the lower rotating shaft 14. The locking frame 131 has two rear ends, a front side, and multiple locking holes 133. The rear ends of the locking frame 131 are connected securely to the lower rotating shaft 14 to enable the locking frame 131 to rotate with the lower rotating shaft 14. The locking holes 133 are formed through the front side of the locking frame 131 at spaced intervals between the lower base 11 and the upper base 12.

The latch 132 is retractably deposited in the lower base 11 in the front of the locking frame 131 and selectively engages one of the locking holes 133 of the locking frame 131. The rope 134 is connected to the latch 132 opposite to the front side of the locking frame 131 and extends out of the lower base 11. The spring 135 is deposited in the lower base 11, is mounted around the rope 134, and has two ends respectively connected to the lower base 11 and the latch 132. In addition, the lower rotating shaft 14 is a hexagonal shaft, and the locking frame 131 has two hexagonal holes respectively formed in the rear ends of the locking frame 131 and connected to the hexagonal shaft cooperatively. Then, the locking frame 131 can be moved with the lower rotating shaft 14, and this is simple in assembly and may provide a good performance in force loading.

The latch 132 is cooperated with the spring 135 to be inserted into one of the locking holes 133 of the locking frame 131, and this enables the splat 20 to be positioned at a tilt angle. When the user wants to adjust the tilt angle of the splat 20 relative to the seat 10, the user may pull the latch 132 via the rope 134 to enable the latch 132 to separate from a corresponding locking hole 133, and this enables the latch 132 to disengage from the locking frame 131. During the adjusting process, the splat 20 is rotated with the lower rotating shaft 14, and the locking frame 131 is rotated with the lower rotating shaft 14. When the splat 20 is tilted backwardly to a tilt angle that is needed by the user, the user may release the rope 134 to enable the latch 132 to move toward and to be inserted into one of the locking holes 133 of the locking frame 131 by a compression force of the spring 135. Then, the splat 20 is securely held at the tilt angle that is needed by the user by the engagement between the latch 132 and the locking frame 131.

With reference to FIGS. 4 and 5, the adjustable chair further has an elastic device 30 deposited in the lower base 11 of the seat 10, and the elastic device 30 has two elastic plates 31 and two blocking rods 32. The elastic plates 31 are deposited in the lower base 11 at a spaced interval and beside the locking frame 131, and each one of the elastic plates 31 has a rear end and a front end. The rear ends of the elastic plates 31 are securely connected to the lower base 11, and the front ends of the elastic plates 31 are free relative to the lower base 11. The blocking rods 32 are deposited in the lower base 11 beside the locking frame 131, and are respectively mounted below the elastic plates 31.

When the splat 20 is tilted relative to the seat 10, the blocking rods 32 are rotated with the locking frame 131. Since the blocking rods 32 are mounted below the elastic plates 31, the elastic plates 31 may provide an elastic effect to the splat 20 via the blocking rods 32 and the locking frame 131, and this may also improve the comfort of the adjustable chair.

Figure 7:
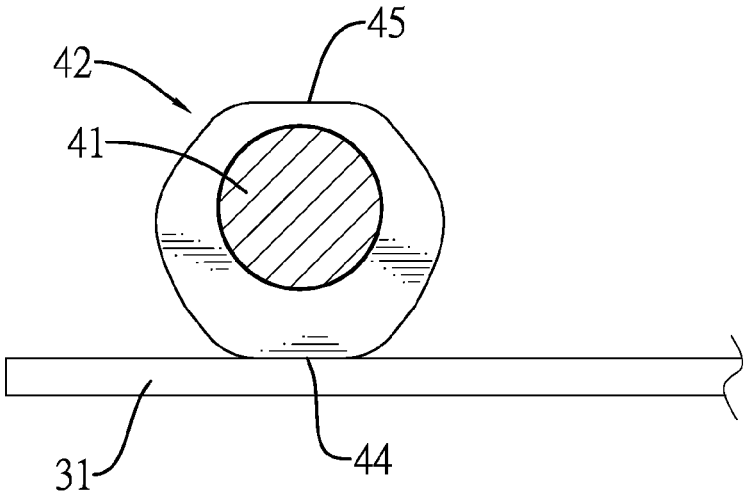
FIG. 7 is an enlarged side view in partial section of an adjusting plate and an elastic block of the adjustable chair in FIG. 4.

With further reference to FIGS. 4 and 5, the adjustable chair further has an elasticity-adjusting device 40 deposited in the lower base 11 of the seat 10, and the elasticity-adjusting device 40 has an adjusting rod 41, two adjusting blocks 42, and an adjusting handle 43. The adjusting rod 41 is rotatably deposited in the lower base 11 adjacent to the front side of the lower base 11, and has an outer end extending out of one of the two opposite sides of the lower base 11. The adjusting blocks 42 are deposited in the lower base 11, are mounted around the adjusting rod 41 at a spaced interval, and are respectively deposited on and abut the front ends of the elastic plates 31. With reference to FIG. 7, each one of the adjusting blocks 42 has an external surface, a first adjusting face 44, and a second adjusting face 45. The adjusting faces 44, 45 are formed on the external surface of the adjusting block 42. The adjusting handle 43 is securely mounted around the outer end of the adjusting rod 41 beside the lower base 11.

Additionally, the elasticity-adjusting device 40 can be used to adjust the elastic strength of the splat 20 that is provided by the elastic device 30. Each one of the adjusting blocks 42 has the first adjusting face 44 and the second adjusting face 45 and a radial distance between the first adjusting face 44 and a center of the adjusting rod 41 is longer than a radial distance between the second adjusting face 45 and the center of the adjusting rod 41. Hence, when adjusting the elastic strength of the splat 20, the user may rotate the adjusting handle 43 to rotate the adjusting rod 41 relative to the lower base 11, and the adjusting blocks 42 are rotated with the adjusting rod 41 relative to the elastic plates 31.

When the first adjusting faces 44 of the adjusting blocks 42 abut the elastic plates 31, the front ends of the elastic plates 31 are pressed downwardly for a larger distance since the radial distance between the center of the adjusting rod 41 and the first adjusting face 44 of each one of the adjusting blocks 42 is longer than the radial distance between the center of the adjusting rod 41 and the second adjusting face 45 of each one of the adjusting blocks 42. As the elastic plates 31 are pressed for larger angles, the elastic strength and the stiffness of the elastic plates 31 are increased.

When the second adjusting faces 45 of the adjusting blocks 42 abut the elastic plates 31, the front ends of the elastic plates 31 are pressed downwardly for a smaller distance since the radial distance between the center of the adjusting rod 41 and the second adjusting face 45 of each one of the adjusting blocks 42 is shorter than the radial distance between the center of the adjusting rod 41 and the first adjusting face 44 of each one of the adjusting blocks 42. As the elastic plates 31 are pressed for smaller angles, the elastic strength and the stiffness of the elastic plates 31 are reduced. Then, the elastic strength of the splat 20 can be adjusted by rotating the adjusting handle 43 to enable the adjusting faces 44, 45 of the adjusting blocks 42 to abut the elastic plates 31.

Furthermore, the two elastic plates 31 and the two blocking rods 32 of the elastic device 30 and the two adjusting blocks 42 of the elasticity-adjusting device 40 are deposited beside the locking frame 131 in the lower base 11, and this may enable force to be uniformly exerted on the adjustable chair and increase the stability and comfort of using the adjustable chair.

With reference to FIG. 4, the adjustable chair further has a limiting device 50 deposited in the lower base 11, and the limiting device 50 has two limiting elements 51. The limiting elements 51 are deposited in the lower base 11 and respectively above the blocking rods 32. The limiting device 50 is used to limit the largest tilt angle of the splat 20 relative to the seat 10. When the splat 20 is tilted backwardly, the blocking rods 32 are rotated with the locking frame 131, and the blocking rods 32 may respectively abut against the limiting elements 51 as the splat 20 is tilted at the largest tilt angle, and this may prevent the adjustable chair from overturning and is safe in use.

In addition, the adjustable chair further has a support 60 and two arms 70. The support 60 is deposited on the closed bottom of the lower base 11 of the seat 10, and the arms 70 are respectively connected to the connecting legs 22 of the splat 20.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable chair comprising:

a seat having a lower base having a closed bottom;

an open top;

a front side;

a rear side;

two opposite sides; and an assembling space formed in the lower base and communicating with the open top of the lower base;

an upper base movably deposited on the lower base to cover the open top of the lower base and having two opposite sides;

a lower rotating shaft rotatably deposited in the lower base adjacent to the rear side of the lower base, and having two outer ends respectively extending out of the two opposite sides of the lower base;

a tilt adjusting device deposited in the assembling space of the lower base, connected to the lower base, and having a locking frame mounted in the lower base, connected securely with the lower rotating shaft, and having two rear ends connected securely to the lower rotating shaft to enable the locking frame to rotate with the lower rotating shaft;

a front side; and multiple locking holes formed through the front side of the locking frame at spaced intervals between the lower base and the upper base;

a latch retractably deposited in the lower base in the front of the locking frame and selectively engaging one of the locking holes of the locking frame;

a rope connected to the latch opposite to the front side of the locking frame and extending out of the lower base; and a spring deposited in the lower base, mounted around the rope, and having two ends respectively connected to the lower base and the latch; and an upper rotating shaft deposited in the upper base, being parallel with the lower rotating shaft, and having two outer ends respectively extending out of the two opposite sides of the upper base; and a splat tiltably connected to the seat and having a backrest unit deposited at a rear side of the seat and having two bottom ends; and two connecting legs respectively connected to the bottom ends of the backrest unit, and each one of the connecting legs securely connected to the lower rotating shaft, pivotally connected to the upper rotating shaft at one of the two opposite sides of the lower base, and having a connecting segment extending upwardly to the seat.

2. The adjustable chair as claimed in claim 1, wherein the lower rotating shaft is a hexagonal shaft; and the locking frame has two hexagonal holes respectively formed in the rear ends of the locking frame and connected to the hexagonal shaft cooperatively to enable the locking frame to move with the lower rotating shaft.

3. The adjustable chair as claimed in claim 1, wherein the adjustable chair further has an elastic device deposited in the lower base of the seat, and the elastic device has two elastic plates deposited in the lower base at a spaced interval and beside the locking frame, and each one of the elastic plates having a rear end securely connected to the lower base; and a front end being free relative to the lower base; and two blocking rods deposited in the lower base beside the locking frame, and respectively mounted below the elastic plates.

4. The adjustable chair as claimed in claim 2, wherein the adjustable chair further has an elastic device deposited in the lower base of the seat, and the elastic device has two elastic plates deposited in the lower base at a spaced interval and beside the locking frame, and each one of the elastic plates having a rear end securely connected to the lower base; and a front end being free relative to the lower base; and two blocking rods deposited in the lower base beside the locking frame, and respectively mounted below the elastic plates.

5. The adjustable chair as claimed in claim 3, wherein the adjustable chair further has an elasticity-adjusting device deposited in the lower base of the seat, and the elasticity-adjusting device has an adjusting rod rotatably deposited in the lower base adjacent to the front side of the lower base, and having an outer end extending out of one of the two opposite sides of the lower base;

two adjusting blocks deposited in the lower base, mounted around the adjusting rod at a spaced interval, and respectively deposited on and abutting the front ends of the elastic plates, and each one of the adjusting blocks having an external surface;

a first adjusting face formed on the external surface of the adjusting block; and a second adjusting face formed on the external surface of the adjusting block; and an adjusting handle securely mounted around the outer end of the adjusting rod beside the lower base.

6. The adjustable chair as claimed in claim 4, wherein the adjustable chair further has an elasticity-adjusting device deposited in the lower base of the seat, and the elasticity-adjusting device has an adjusting rod rotatably deposited in the lower base adjacent to the front side of the lower base, and having an outer end extending out of one of the two opposite sides of the lower base;

two adjusting blocks deposited in the lower base, mounted around the adjusting rod at a spaced interval, and respectively deposited on and abutting the front ends of the elastic plates, and each one of the adjusting blocks having an external surface;

a first adjusting face formed on the external surface of the adjusting block; and a second adjusting face formed on the external surface of the adjusting block; and an adjusting handle securely mounted around the outer end of the adjusting rod beside the lower base.

7. The adjustable chair as claimed in claim 5, wherein the adjustable chair further has a limiting device deposited in the lower base, and the limiting device has two limiting elements deposited in the lower base and respectively above the blocking rods.

8. The adjustable chair as claimed in claim 6, wherein the adjustable chair further has a limiting device deposited in the lower base, and the limiting device has two limiting elements deposited in the lower base and respectively above the blocking rods.

* * * * *